US008955965B2

(12) United States Patent
Norikane

(10) Patent No.: US 8,955,965 B2
(45) Date of Patent: Feb. 17, 2015

(54) RECORDING APPARATUS

(71) Applicant: Shunsuke Norikane, Nagoya (JP)

(72) Inventor: Shunsuke Norikane, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/191,874

(22) Filed: Feb. 27, 2014

(65) Prior Publication Data

US 2014/0240428 A1 Aug. 28, 2014

(30) Foreign Application Priority Data

Feb. 28, 2013 (JP) ..... 2013-040075

(51) Int. Cl.

| | |
|---|---|
| ***B41J 2/01*** | (2006.01) |
| ***B41J 11/00*** | (2006.01) |
| ***B41J 13/26*** | (2006.01) |
| *B65H 20/00* | (2006.01) |
| *B65H 9/00* | (2006.01) |
| *B65H 5/12* | (2006.01) |
| *B41J 13/02* | (2006.01) |
| *B41J 13/08* | (2006.01) |

(52) U.S. Cl.

CPC ..... *B41J 11/0055* (2013.01); *B41J 11/006* (2013.01); *B41J 13/02* (2013.01); *B41J 13/26* (2013.01)

USPC ..... 347/104; 226/190; 226/193; 400/641; 271/226; 271/268

(58) Field of Classification Search

CPC ..... B41J 11/06; B41J 11/007; B41J 11/0085; B41J 11/0045; B41J 13/02; B65H 29/40; B65H 29/42; B65H 2404/00; B65H 2404/10; B65H 2404/111; B65H 2404/1115; B65H 2404/1116; B65H 2404/1118; B65H 2404/1119; B65H 2404/65

USPC ..... 347/104; 226/190, 193; 400/641; 271/226, 268

See application file for complete search history.

(56) References Cited

U.S. PATENT DOCUMENTS

| | | | | |
|---|---|---|---|---|
| 5,850,233 | A | 12/1998 | Otsuka et al. | |
| 5,912,690 | A | 6/1999 | Endo et al. | |
| 2014/0240429 | A1 * | 8/2014 | Norikane et al. | 347/104 |

FOREIGN PATENT DOCUMENTS

| | | |
|---|---|---|
| JP | H03293136 | 12/1991 |
| JP | H10129911 | 5/1998 |
| JP | H11130299 | 5/1999 |
| JP | 2007-161361 | 6/2007 |

* cited by examiner

*Primary Examiner* — Laura Martin
*Assistant Examiner* — Jeremy Bishop
(74) *Attorney, Agent, or Firm* — Frommer Lawrence & Haug LLP

(57) ABSTRACT

A recording apparatus includes a recording section configured to jet a liquid, and a transport mechanism configured to transport a recording medium on which an image is recorded by the liquid jetted from the recording section. The transport mechanism includes a guide surface extending linearly and configured to guide one of two lateral ends of the recording medium transported, a driving roller configured to contact with one surface of the recording medium on a side with no image recorded and to transport the recording medium; and a driven spur having at least one spur configured to contact with the other surface of the recording medium on the side with the image recorded so as to nip the recording medium in cooperation with the driving roller, and to rotate along with the transport of the recording medium by the rotation of the driving roller.

11 Claims, 6 Drawing Sheets

RECORDING APPARATUS

CROSS REFERENCE TO RELATED APPLICATION

The present application claims priority from Japanese Patent Application No. 2013-040075, filed on Feb. 28, 2013, the disclosure of which is incorporated herein by reference in its entirety.

BACKGROUND OF THE INVENTION

1. Field of the Invention

The present invention relates to a recording apparatus for recording images.

2. Description of the Related Art

Japanese Patent Application Laid-open No. H11-130299 discloses a roller pair which moves a recording medium (sheet material) along a guide surface (reference wall) to carry out registration for the recording medium. This roller pair has a transport roller and a skew roller. The transport roller has a rotational shaft orthogonal to the guide surface and transports the recording medium in a transport direction. The skew roller has a cylindrical outer periphery. Further, the skew roller has a rotational shall inclined with respect to the rotational shaft of the transport roller so as to be capable of rotating along with the transport of the recording medium to move the recording medium close to the guide surface. By this configuration, the registration is carried out for the recording medium.

Japanese Patent Application Laid-open No. 2007-161361 discloses a spur skew roller pair which moves a recording medium along a guide surface to carry out registration for the recording medium. The spur skew roller pair disclosed in Japanese Patent Application Laid-open No. 2007-161361 uses a spur instead of the skew roller constituting the roller pair disclosed in the Japanese Patent Application Laid-open No. H11-130299.

Due to the roller pair disclosed in Japanese Patent Application Laid-open No. H11-130299, in the registration for the recording medium, even if an end surface of the recording medium contacts with the guide surface, the recording medium is still moved close to the guide surface by the skew roller. On this occasion, due to the recording medium in contact with the guide surface, a thrust load occurs on the skew roller but, because the recording medium is likely to slip from the skew roller (to move in a direction away from the guide surface), it is possible to restrain the occurrence of a jam of the recording medium. However, if a slip occurs between the skew roller and the recording medium, because the skew roller scrapes images recorded on the recording medium, such a problem that the images are damaged may arise. Further, if the skew roller contacts with the images recorded on the recording medium, such a problem may occur that the recording material for forming the images adheres to the outer periphery of the skew roller and the recording material adhered to the skew roller is transferred to the recording medium to contaminate the recording medium.

On the other hand, if a spur is used instead of the skew roller as in Japanese Patent Application Laid-open No. 2007-161361, because each tooth of the spur has an extremely small contact area with the recording medium in comparison with the skew roller, it is possible to restrain contamination of the recording medium. However, in the registration for the recording medium, because each tooth of the spur pierces the surface of the recording medium as a spike, even if a thrust load occurs on the spur due to the end surface of the recording medium in contact with the guide surface, the recording medium almost does not slip with respect to the spur. As a result, a jam of the recording medium may occur.

SUMMARY OF THE INVENTION

An object of the present invention is to provide a recording apparatus capable of restraining the occurrence of a jam of the recording medium and restraining the occurrence of contamination of the recording medium.

According to an aspect of the present invention, there is provided a recording apparatus including: a recording section configured to jet a liquid; and a transport mechanism configured to transport a recording medium on which an image is recorded by the liquid jetted from the recording section, wherein the transport mechanism includes: a guide surface extending linearly and configured to guide one of two lateral ends of the recording medium transported; a driving roller configured to contact with one surface of the recording medium on a side with no image recorded and to transport the recording medium; and a driven spur having at least one spur configured to contact with the other surface of the recording medium on the side with the image recorded so as to nip the recording medium in cooperation with the driving roller, and to rotate along with the transport of the recording medium by the rotation of the driving roller, an angle formed by a portion of the guide surface, which is disposed on a downstream side in a transport direction for transporting the recording medium from a point of intersection between an axis of a rotational shaft of the driven spur and the guide surface, and the axis of the rotational shaft of the driven spur is an acute angle, the spur has a plurality of teeth arranged to align in a circumferential direction about the axis of the rotational shaft of the driven spur and each projecting in a direction orthogonal to the axis of the rotational shaft of the driven spur as viewed from an axis direction along the axis of the rotational shaft of the driven spur, each of the teeth has two first lateral surfaces inclined to get closer to a virtual line orthogonal to the axis from a base to a tip of the tooth as viewed from the axis direction, and an apical surface formed at a position closer to the axis than a line of intersection between two virtual planes extending along the two first lateral surfaces, and at least one first lateral surface among the two first lateral surfaces has a first recess denting toward the rotational shaft and connected to the apical surface, the at least one first lateral surface being disposed on an upstream side with respect to a rotational direction in which the driven spur is rotated along with the transport of the recording medium.

According to the recording apparatus of the above aspect of the present invention, because every apical surface of the respective teeth of the spur is discontinuous in the circumferential direction as compared with a roller having a cylindrical outer periphery, there is a small area of contact with the recording medium, and thus the liquid is less transferable from the spur to the recording medium. Further, among the two first lateral surfaces, at least an upstream first lateral surface has the first recess denting toward the rotational shaft of the driven spur and being connected to the apical surface. Therefore, the liquid adhered to the apical surface of each tooth is more likely to flow to the first recess formed in the upstream first lateral surface in the rotational direction due to the rotation of the driven spur. As a result, the liquid from the apical surfaces of the teeth becomes little and thus less transferable to the recording medium. In addition, the teeth have the apical surfaces whereby the teeth are less likely to pierce the recording medium. Hence, even when the driving roller and driven spur move the recording medium close to the guide surface and cause the recording medium, to contact with the guide surface, and a thrust load occurs on the tooth tips of the spur, the recording medium is still likely to move relative to the tooth tips in a direction away from the guide surface. As a result, it is possible to restrain the occurrence of a jam of the recording medium. In this manner, it is possible to restrain both the occurrence of a jam of the recording medium and the occurrence of contamination of the recording medium.

BRIEF DESCRIPTION OF THE DRAWINGS

FIGS. 5A to 5C show conditions of positioning operation of a sheet of paper by the positioning mechanism, wherein FIG. 5A is a diagram showing the condition when the paper is transported by a driving roller and the driven spur, FIG. 5B is another diagram showing the condition when the paper is transported while contacting a guide surface, and FIG. 5C is a partial cross-sectional view showing the contact condition between the tooth and the paper when the paper is transported while contacting the guide surface.

FIGS. 6A to 6C show a modification of a spur according to the present invention, wherein FIG. 6A is an enlarged perspective view of a main section of a tooth of the spur, FIG. 6B is a partial cross-sectional view showing a contact condition between the tooth and the paper when the paper is transported while contacting the guide surface, and FIG. 6C is a partial cross-sectional view showing shapes of first lateral surfaces of the tooth.

DESCRIPTION OF THE PREFERRED EMBODIMENT

Hereinbelow, referring to the accompanying drawings, a preferred embodiment of the present invention will be explained.

Figure 1:
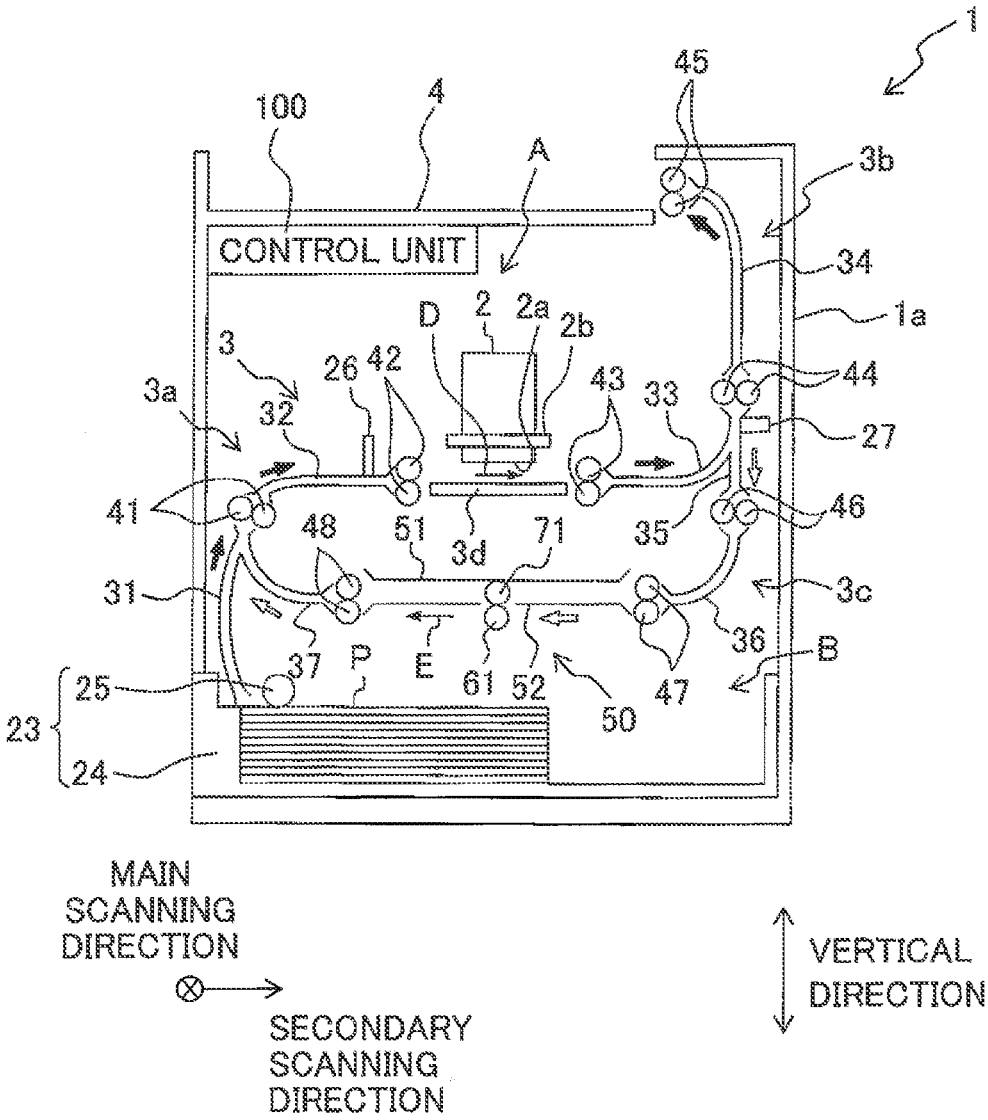
FIG. 1 is a schematic lateral view showing an internal structure of an ink jet printer according to an embodiment of a recording apparatus of the present invention.

First, referring to FIG. 1, an explanation will be given about a general configuration of an ink jet printer 1 as one embodiment of a recording apparatus according to the present invention.

The printer 1 has a cuboid-shaped case 1*a*. A paper discharge portion 4 is provided above the top board of the case 1*a*. The internal space of the case 1*a* can be divided into a space A and a space B in order from above. In the spaces A and B, there are formed a paper transport path from a paper feed portion 23 to the paper discharge portion 4, and a paper re-transport path from downstream side to upstream side of the paper transport path. Sheets of paper P are, as shown in FIG. 1, transported along the black bold arrows in the paper transport path, and transported along the outlined bold arrows in the paper re-transport path. In the space A, recording images on the paper P, transporting the paper P to the paper discharge portion 4, and re-transporting the paper P are carried out. In the space B, feeding the paper P from the paper feed portion 23 to the paper transport path is carried out.

In the space A, there are arranged a head (recording section) 2 serving to jet black ink, a transport device 3, a control device 100, etc. Further, in the space A, an =shown cartridge is installed. The black ink is retained in this cartridge. The cartridge is connected with the head 2 via a tube and a pump (both not shown) to supply the ink to the head 2.

The head 2 is a line head having an approximately cuboid shape elongated in a main scanning direction. The lower surface of the head 2 is a jet surface 2*a* with a number of open nozzles. Whenever recording is carried out, the black ink is jetted from the jet surface 2*a*. The head 2 is supported by the case 1*a* via a head holder 2*b*. The head holder 2*b* holds the head 2 such that a predetermined interspace appropriate for the recording may be formed between the jet surface 2*a* and a platen 3*d* (aftermentioned).

The transport device 3 has an upstream guide portion 3*a*, a downstream guide portion 3*b*, a re-transport guide portion 3*c*, and the platen 3*d*. The platen 3*d* is arranged at a position facing the jet surface 2*a*. The platen 3*d* has a flat upper surface to support the paper P from below as well as to form a recording area (part of the paper transport path) between itself and the jet surface 2*a*. The upstream guide portion 3*a* and the downstream guide portion 3*b* are arranged across the platen 3*d*. The upstream guide portion 3*a* has two guides 31 and 32 and two transport roller pairs 41 and 42 to link the recording area (between the platen 3*d* and the head 2) and the paper feed portion 23. The downstream guide portion 3*b* has two guides 33 and 34 and three transport roller pairs 43 to 45 to link the recording area and the paper discharge portion 4. The paper transport path is defined by the four guides 31 to 34, the platen 3*d*, and the head 2.

The re-transport guide portion (transport mechanism) 3*c* has three guides 35 to 37, three transport roller pairs 46 to 48, and a positioning mechanism 50 to bypass the recording area and link the upstream guide portion 3*a* and the downstream guide portion 3*b*. The guide 35 is connected to a midway part of the guide 33 to link the re-transport guide portion 3*c* and the downstream guide portion 3*b*. The guide 37 is connected to a midway part of the guide 31 to link the re-transport guide portion 3*c* and the upstream guide portion 3*a*. The paper re-transport path is defined by the three guides 35 to 37 and the positioning mechanism 50.

Further, the transport roller pair 44 can be controlled by the control device 100 to switch the transport direction for the paper P. That is, when transporting the paper P from the recording area to the paper discharge portion 4, the transport roller pair 44 rotates to transport the paper P upward. On the other hand, when transporting the paper P from the paper transport path to the paper re-transport path, if a paper sensor 27 has detected the posterior end of the paper P which is present at that time between the transport roller pair 44 and the place connecting the guide 33 and the guide 35, then the transport roller pair 44 is caused to switch its rotational direction to transport the paper P downward with its posterior end as its anterior end. The paper P transported from the paper transport path to the paper re-transport path is re-transported to the upstream guide portion 3*a*. On this occasion, the re-transported paper P is transported again to the recording area with its front and back sides being reversed as compared with the previous time of passing through the recording area, in this manner, it is possible to record images on both sides of the paper P.

The three transport roller pairs 46 to 48 are arranged in this order (from 46 to 48), while the positioning mechanism 50 is arranged between the transport roller pairs 47 and 48. Further, the positioning mechanism 50 is arranged between the recording area (platen 3*d*) and the paper feed portion 23 in a vertical direction. The positioning mechanism 50 has an upper guide 51, a lower guide 52, a driving roller 61, and a driven spur 71. Further, the positioning mechanism 50 positions the paper P in its width direction by transporting the paper P while causing one end of the paper P, which is transported there between the two guides 51 and 52, in the width direction (the main scanning direction as well as the direction orthogonal to the transport direction E of the paper P), to contact with a guide surface 54*a* (aftermentioned). Details of the positioning mechanism 50 will be described later.

The paper feed portion 23 is arranged in the space B. The paper feed portion 23 has a paper feed tray 24 and a paper feed roller 25, wherein the paper feed tray 24 is insertable to and removable from the case 1*a*. The paper feed tray 24 is a box with an open top, and is capable of containing a plurality of sheets of the paper P. The paper feed roller 25 sends out the uppermost sheet of the paper P in the paper feed tray 24.

Here, a secondary scanning direction refers to a paper transport direction D in which the paper P is transported by the transport roller pairs 42 and 43, as well as to a direction parallel to the paper transport direction E in which the paper P is transported by the transport roller pairs 47 and 48. The main scanning direction refers to a direction parallel to a horizontal plane and orthogonal to the secondary scanning direction.

Next, the control device 100 will be explained. The control device 100 controls the operation of each portion of the printer 1 to govern the entire operation of the printer 1. The control device 100 controls the recording operation based on recording commands supplied from external devices (PCs and the like connected with the printer 1.). In particular, the control device 100 controls a transport operation of the paper P, an ink jet operation synchronized with the transport of the paper P, and the like.

When receiving a recording command from an external device to carry out recording on one side of the paper P, for example, the control device 100 drives the paper feed portion 23 and the transport roller pairs 41 to 45 based on this recording command. The paper P sent out from the paper feed tray 24 is guided by the upstream guide portion 3*a* and sent to the recording area (between the platen 3*d* and the head 2). When the paper P is passing right below the head 2, the head 2 is controlled by the control device 100 to jet ink droplets. By virtue of this, desired images are recorded on a surface of the paper P. The ink jet operation (ink jet timing) is based on a detection signal from a paper sensor 26. Further, the paper sensor 26 is arranged upstream to the head 2 in the transport direction to detect the anterior end of the paper P. Then, the paper P with recorded images is guided by the downstream guide portion 3*b* to be discharged from an upper portion in the case la to the paper discharge portion 4.

Further, when receiving a recording command from an external device to carry out recording on both sides of the paper P, for example, the control device 100 drives the paper feed portion 23 and the transport roller pairs 41 to 45 based on this recording command. First, in the same manner as in the one-side recording, images are formed on a surface of the paper P, which is then transported toward the paper discharge portion 4. As shown in FIG. 1, the paper sensor 27 is arranged on the downstream guide portion 3*b* on the way of transport in the vicinity of the transport roller pair 44 on the upstream side. If the paper sensor 27 has detected the posterior end the paper P, then under the control of the control device 100, the transport roller pair 44 is rotated inversely to reverse the direction of transporting the paper P. At this time, the transport roller pairs 46 to 48 and the driving roller 61 are also driven to rotate. By virtue of this, the paper P is, its path being switched, transported along the paper re-transport path (the path indicated by the outlined arrows). At this time, the positioning mechanism 50 positions the paper P in the main scanning direction, and the positioned paper P is re-transported to the recording area. The paper P re-transported from the paper re-transport path to the upstream guide portion 3*a* is, its front and back sides being reversed, resupplied to the recording area to record images on the back side. Further, when the paper sensor 26 has detected the anterior end of the paper P before the image recording on the hack side, the transport roller pair 44 is restored to the normal rotation. The paper P with images recorded on both sides is then discharged to the paper discharge portion 4 via the downstream guide portion 3*b*.

Figure 2:
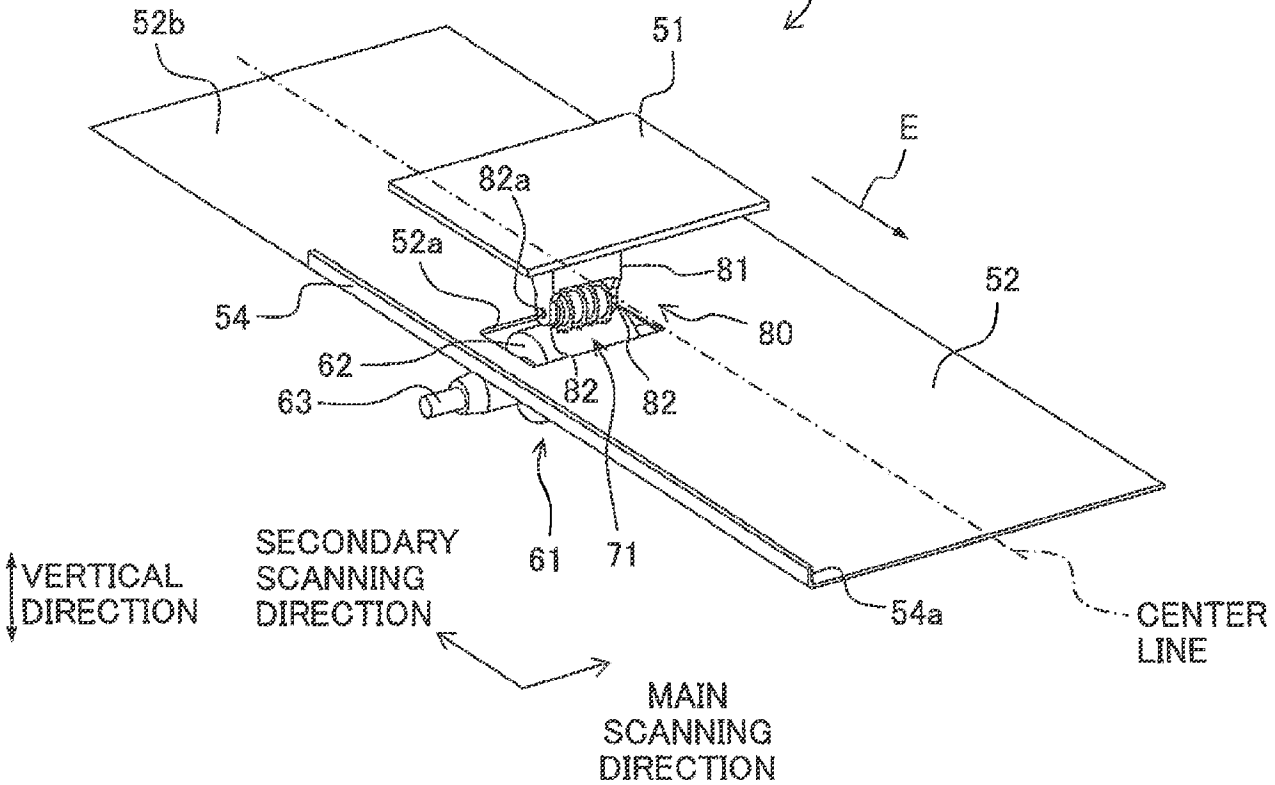
FIG. 2 is a schematic perspective view of a positioning mechanism shown in FIG. 1.
Figure 3:
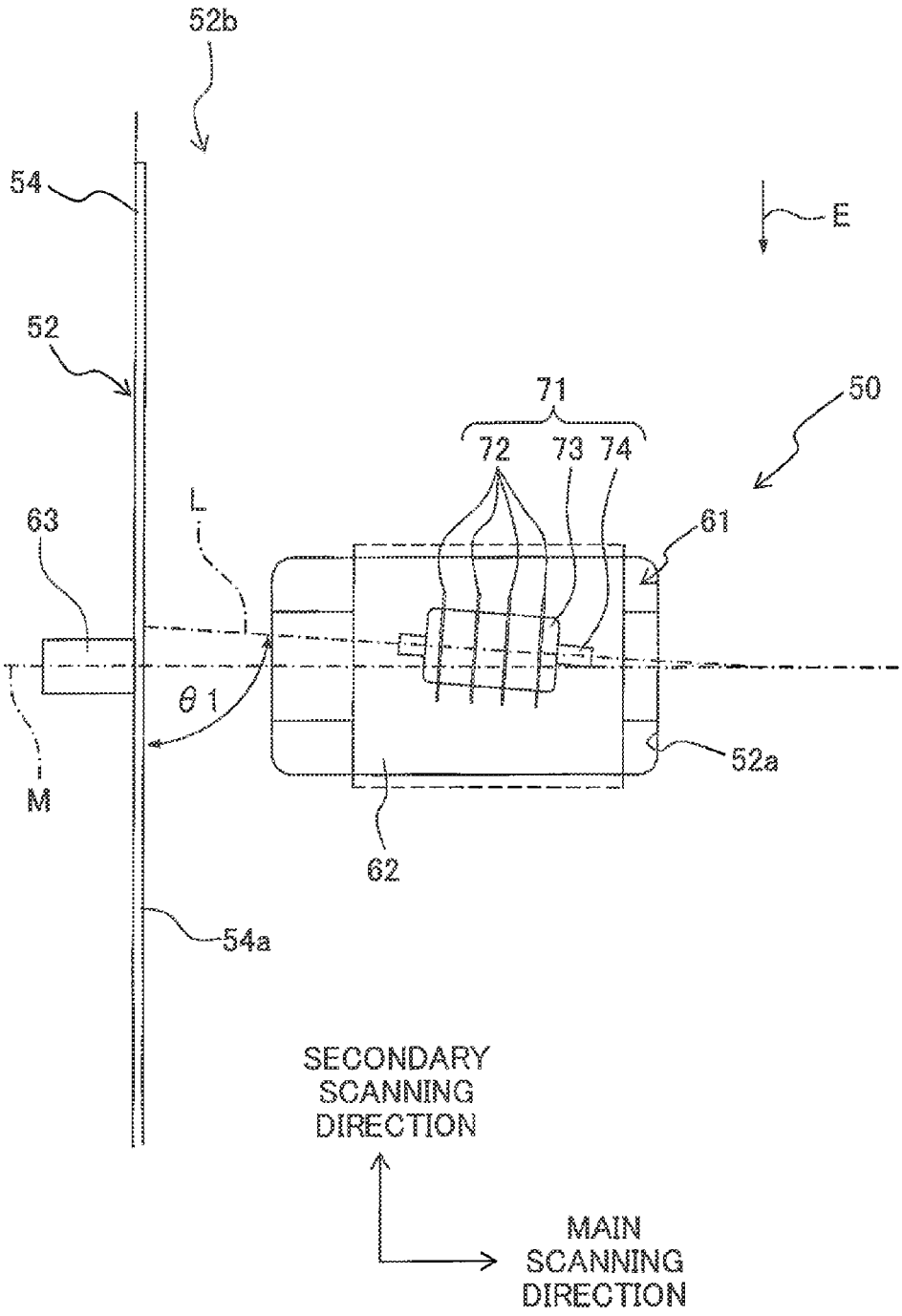
FIG. 3 is a plan view of a main section of the positioning mechanism.

Next, referring to FIGS. 2 through 4D, the positioning mechanism 50 will be explained in detail. As shown in FIG. 2, the upper guide 51 and the lower guide 52 of the positioning mechanism 50 are both plate-like members arranged apart from each other in the vertical direction. The space between these guides 51 and 52 constitutes a part of the paper re-transport path (transport path). A hole 52*a* is formed through the lower guide 52 in its thickness direction. The hole 52*a* is, as shown in FIG. 3, a little smaller than the driving roller 61 in terms of its width in the secondary scanning direction. The lower guide 52 has a transport surface 52*b* to support the lower surface of the paper P transported. On one end of the lower guide 52 in the main scanning direction, a vertical portion 54 is formed to stand upright in the vertical direction. This vertical portion 54 extends along the secondary scanning direction, and has the guide surface 54*a* which is a vertical plane including the secondary scanning direction. The guide surface 54*a* is formed by the lateral surface of the vertical portion 54 at the side of the driven spur 71. Further, only a part of the upper guide 51 is shown in FIG. 2.

The driving roller 61 and the driven spur 71 facing the driving roller 61 are arranged in a position closer to the guide surface 54*a* than the center of the transport path between the upper guide 51 and the lower guide 52 (the center line shown in FIG. 2 by the chain line) in the main scanning direction. The driven spur 71 is rotated by the rotation of the driving roller 61 or along with the transport of the paper P transported by the driving roller 61.

As shown in FIG. 2, the driving roller 61 has a cylindrical roller body 62, and a shaft 63 rotating together with the roller body 62. The roller body 62 is arranged below the driven spur 71 in a position facing the hole 52*a*. The roller body 62 is arranged so that its upper part is projected upward slightly above the transport surface 52*b* of the lower guide 52 to contact with the lower surface of the paper P transported on the transport surface 52*b*. That is, the driving roller 61 is arranged to be contactable with a surface, of the paper P, on which no image is recorded. The shaft 63 is inserted through the roller body 62 and fixed in the roller body 62 to form the rotational shaft of the driving roller 61. The shaft 63 is supported rotatably by the case 1*a*. The positioning mechanism 50 has an unshown drive mechanism (such as a drive motor, and gear wheels and the like transmitting the rotative force from the drive motor). This drive mechanism is driven to operate through the control of the control device 100 to rotate the roller body 62 via the shaft 63. As shown in FIG. 3, the driving roller 61 is arranged such that an axis M of the shaft 63 may be parallel to the main scanning direction. That is, the driving roller 61 is arranged such that the axis M of the shaft 63 may be orthogonal to the guide surface 54*a*.

Further, as shown in FIG. 2, the positioning mechanism 50 has a supporter 80 supporting the driven spur 71. The supporter 80 has a supporter body 81, and a biasing portion (not shown) biasing the supporter body 81 downward. The supporter body 81 is attached to the lower surface of the upper guide 51 via the biasing portion. A pair of flanges 82 are formed on the lower surface of the supporter body 81 to project downward. Holes 82*a* are formed in the pair of flanges 82 to penetrate therethrough in the main scanning direction. By inserting a shaft 74 of the driven spur 71 through these holes 82*a*, the driven spur 71 is supported rotatably by the supporter 80. The biasing portion is constructed of an elastic member such as a coil spring or the like fixed on the upper guide 51 to bias, along with the supporter body 81, the driven spur 71 toward, the driving roller 61 (downward). By virtue of this, between the driven spur 71 and the driving roller 61, a predetermined nipping force is generated to nip the paper P. Therefore, the paper P is transported in the transport direction E while being nipped by the driving roller 61 and driven spur 71. Further, the driven spur 71 is arranged so that the driven spur 71 contacts a recording surface, of the paper P, on which images are recorded.

As shown in FIG. 3, the driven spur 71 has four spurs 72, a cylindrical roller body 73, and the shaft 74 rotating together with the roller body 73, and is arranged in a position overlapping the guide surface 54*a* in the transport direction E. The shaft 74 is inserted through the roller body 73 and fixed in the roller body 73 to form the rotational shaft of the driven spur 71. Further, as shown in FIG. 3, the shaft 74 is arranged such that an angle θ1, formed between an axis L and the downstream part of the guide surface 54*a* in the transport direction E from the point of intersection between the axis L and the guide surface 54*a*, may be (an acute angle of) 85 to 89 degrees, for example, or more preferably 88 degrees. Further, as viewed from the transport direction F, the shaft 74 is arranged such that the axis L is almost orthogonal to the guide surface 54*a*, i,e., at approximately 90 degrees.

Figure 4A:
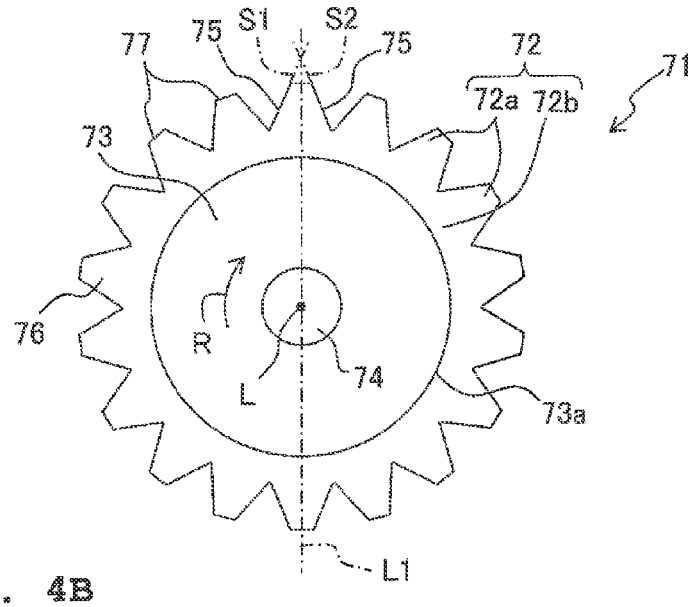
FIG. 4A is a lateral view of a driven spur.

As shown in FIG. 4A, each of the spurs 72 is a metallic thin-plate member having a plurality of teeth 72*a* and an annular portion 72*b* fixed on an outer periphery 73*a* of the roller body 73. As viewed from a direction along the axis L, the plurality of teeth 72*a* are arranged to project from the annular portion 72*b* in directions orthogonal to the axis L, and to align along a circumferential direction R about the axis L (the direction indicated by arrow R in FIG. 4A). As shown in FIG. 4A, each of the teeth 72*a* has two first lateral surfaces 75 along the axis L direction, two second lateral surfaces 76 orthogonal to the axis L direction, and an apical surface 77 connected to those four lateral surfaces 75 and 76. The two first lateral surfaces 75 are inclined to get closer to a virtual line L1 orthogonal to the axis L (toward the outer side along the radial direction) from the base of the tooth 72*a* (the part connected with the annular portion 72*b*) toward the tooth tip. The two second lateral surfaces 76 are arranged to he parallel to each other. The apical surface 77 is formed at a position closer to the axis L than the line of intersection between two virtual planes S1 and S2 extending along the two first lateral surfaces 75. Therefore, the tooth tip of each tooth 72*a* is not so sharply pointed, and the driven spur 71 is less likely to pierce the paper P with the tips of the teeth 72*a*. As a result, since the apical surfaces 77 contact with the paper P in a state that the tooth tips do not cut into the paper P deeply, the driven spur 71 rotates along with the transport of the paper P.

Figure 4B:
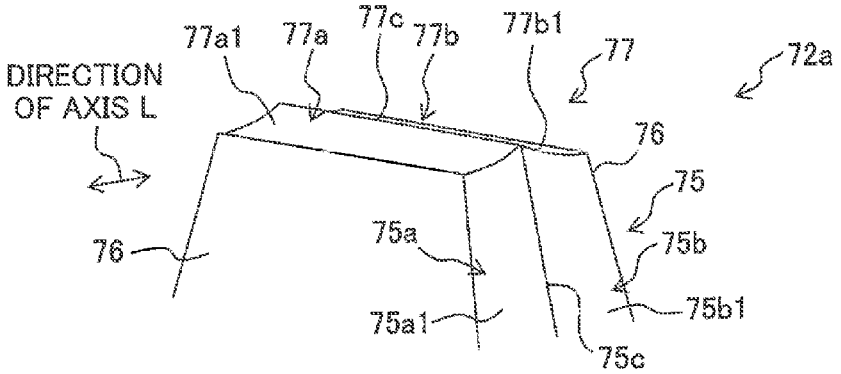
FIG. 4B is an enlarged perspective view of a main section of a tooth of the spur.
Figure 4C:
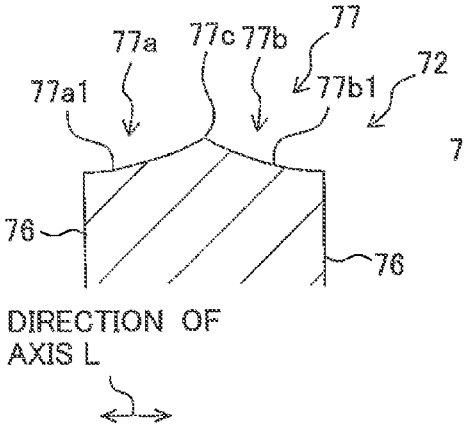
FIG. 4C is a partial cross-sectional view showing a shape of an apical surface of the tooth.

As shown in FIG. 4B, each of the apical surfaces 77 has two recesses 77*a* and 77*b* extending to be linked with the two first lateral surfaces 75. These two recesses (second recesses) 77*a* and 77*b* are formed respectively of curved surfaces 77*a*1 and 77*b*1 denting toward the axis L, and arranged to align in the axis L direction. As shown in FIG. 4C, the curved surface 77*a*1 is curved to get closer to the axis L from the center of the apical surface 77 in the axis L direction to the second lateral surface 76 on the left side in the figure. Still as shown in FIG. 4C, the curved surface 77*b*1 is curved to get closer to the axis L from the center of the apical surface 77 in the axis L direction to the second lateral surface 76 on the right side in the figure. By these curved surfaces 77*a*1 and 77*b*1, the apical surface 77 is formed with a peak 77*c* projecting at the central part in the axis L direction. In this manner, the apical surface 77 has the curved surface 77*a*1 curved to get closer to the axis L from the peak 77*c* to the second lateral surface 76 on the left side in the figure, and the curved surface 77*b*1 curved to get closer to the axis L from the peak 77*c* to the second lateral surface 76 on the right side in the figure. Therefore, as compared with a spur 272 of an aftermentioned modification with a curved surface 277*a*1 of an apical surface 277 having one recess 277*a*, it is possible to form a gradual inclination angle for each of the curved surfaces 77*a*1 and 77*b*1. By virtue of this, when the teeth 72*a* of the spur 72 come to contact with the paper P and to pierce the same, because there is a comparatively large resistance, the driven spur 71 becomes comparatively less likely to pierce the paper P with the tips of the teeth 72*a*. Further, because each of the curved surfaces 77*a*1 and 77*b*1 has a comparatively gradual inclination angle, it is possible to strengthen the peak 77*c* comparatively, thereby restraining the damage of the peak 77*c*.

Figure 4D:
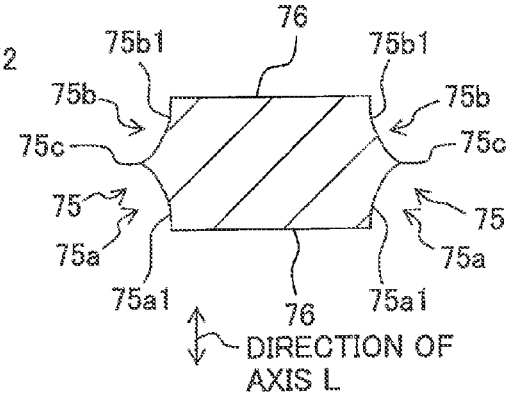
FIG. 4D is a partial cross-sectional view showing a shape of first lateral surfaces of the tooth.

As shown in FIGS. 4B and 4D, each of the two first lateral surfaces 75 of each tooth 72*a* also has two recesses 75*a* and 75*b*. Further, while only one first lateral surface 75 is shown in FIG. 4B, as shown in FIG. 4D, the other first lateral surface 75 also has two recesses 75*a* and 75*b*. These recesses 75*a* and 75*b* extend from the tooth tip to the base of the tooth 72*a*, and the ends on one side are linked with the recesses 77*a* and 77*b* of the apical surface 77 while the ends on the other side are linked with the recesses 75*a* and 75*b* of another tooth 72*a* adjacent, respectively. Further, the recesses (first recess) 75*a* and 75*b* are formed respectively of curved surfaces 75*a*1 and 75*b*1 denting toward the axis L, and arranged to align in the axis L direction. Similar to the curved surface 77*a*1, the curved surface 75*a*1 is also curved to get closer to the axis L from the center of the first lateral surface 75 in the axis L direction to the second lateral surface 76 on the left side in FIG. 4C. Similar to the curved surface 77*b*1, the curved surface 75*b*1 is curved to get closer to the axis L from the center of the first lateral surface 75 in the axis L direction to the second lateral surface 76 on the right side in FIG. 4C. By these curved surfaces 75*a*1 and 75*b*1, each of the first lateral surfaces 75 is also formed with a peak 75*c* projecting at the central part in the axis L direction.

Further, the spur 72 is produced through two-side etching processing. That is, a mask of a pattern of the spur 72 is applied to (to form a resist on) both sides (the second lateral surfaces 76) of the metallic thin-plate member. Thereafter, a predetermined etching liquid is adhered to the both sides of the thin-plate member. By virtue of this, with respect to the axis direction, the part not covered by the mask on the thin-plate member is removed, and the spur 72 is produced. With the spur 72 produced through such two-side etching processing, the apical surface 77 is formed with the two recesses 77*a* and 77*b*, and each of the first lateral surfaces 75 is formed with the two recesses 75*a* and 75*b*. Through such two-side etching processing, it is possible to form the recesses 75*a*, 75*b*, 77*a*, and 77*b* in the spur 72 in a simplified manner. In addition, in the two-side etching processing, the thin-plate member is eroded through dissolution from the both sides. Therefore, as compared with one-side etching processing, the two-side etching processing can secure a higher precision of shape at the rate of allowing a smaller amount of dissolution from one side. As a result, it is possible to secure a higher precision of transport.

Figure 5A:
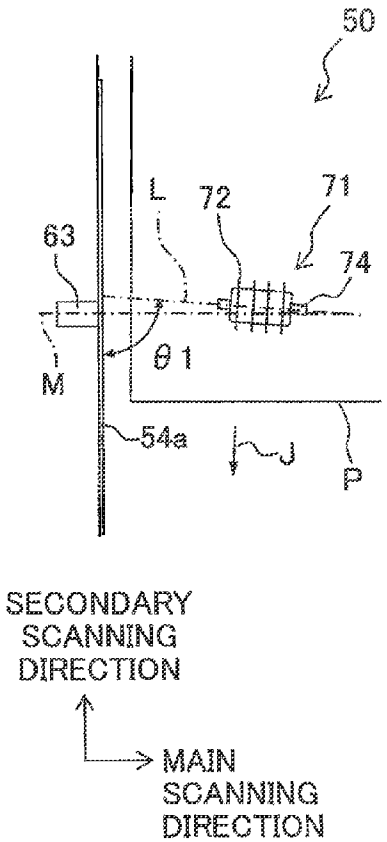
Figure 5B:
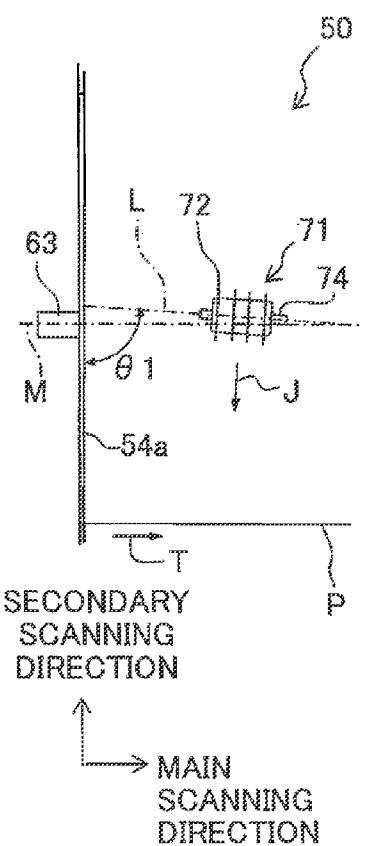
Figure 5C:
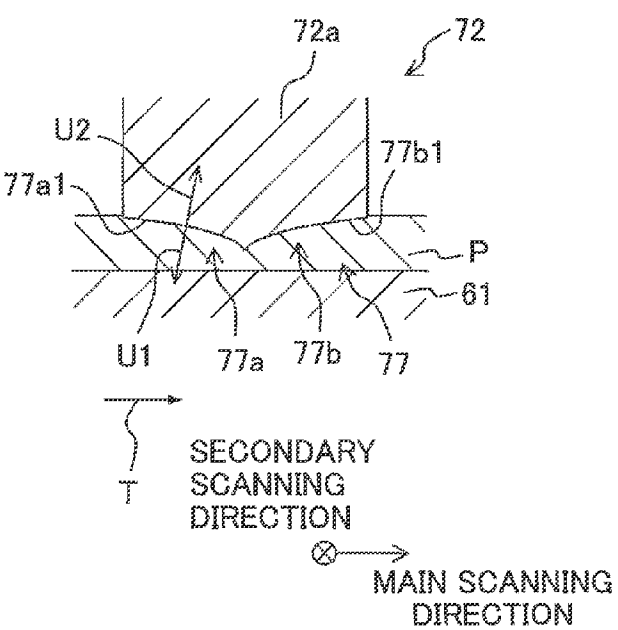

Next, referring to FIGS. 5A to 5C, an explanation will be given below about a positioning operation of the paper P by the positioning mechanism 50.

First, the paper P is transported to the positioning mechanism 50 by the transport roller pair 47. As shown in FIG. 5A, when the anterior end of the paper P reaches the driving roller 61 and driven spur 71, the paper P is transported by the driving roller 61 in a direction J. That is, when any of the teeth 72*a* of the driven spur 71 contacts with the paper P, the moving direction of that tooth 72*a* is orthogonal to the axis L; therefore, the paper P is transported in the direction J approaching the guide surface 54*a*. Then, the lateral end of the paper P on the side near the guide surface 54*a* contacts with the guide surface 54*a*. In this manner, the entire paper P is moved closer to the guide surface 54*a* as shown in FIG. 5B.

Further, the driven spur 71 rotates along with the transport of the paper P while letting the apical surfaces 77 of the teeth 72*a* successively contact with the paper P. Because it is the apical surfaces 77 of the respective teeth 72*a* that contact with the paper F, the driven spur 71 has a very small contact area with the paper P as compared with a roller having a cylindrical outer periphery. Therefore, even if some ink adheres to the apical surfaces 77 due to the contact with images, because the apical surfaces 77 are small in themselves, little ink is transferred to the paper P. As a result, the ink becomes less transferable from the driven spur 71 to the paper P. Further, due to the rotation of the driven spur 71, the ink adhered to the apical surfaces 77 of the respective teeth 72*a* moves to the first lateral surfaces 75 (upstream first lateral surfaces) on the upstream side in the rotational direction. Further, if the driven spur 71 rotates along with the transport of the paper P in a clockwise rotational direction the arrow R direction) in FIG. 4A, then for the tooth 72*a* positioned at the uppermost point in FIG. 4A among the plurality of teeth 72*a* of the spur 72, the first lateral surface 75 on the upstream side in the rotational direction is on the left side among the two first lateral surfaces 75 of that tooth 72*a*. On the other hand, for the tooth 72*a* positioned at the lowermost point in FIG. 4A among the plurality of teeth 72*a* of the spur 72, the first lateral surface 75 on the downstream side in the rotational direction is on the right side among the two first lateral surfaces 75 of that tooth 72*a*. As a result of the ink having moved, the ink on the apical surfaces 77 of the teeth 72*a* decreases and thus is less transferable to the paper P.

Further, each of the apical surfaces 77 is formed with the recesses 77*a* and 77*b*. As compared with flat surfaces, these recesses 77*a* and 77*b* are more likely to retain the ink because of the occurrence of capillary action. Therefore, even if the apical surfaces 77, with the ink retained, contact with the paper P, a part of the ink retained in the recesses 77*a* and 77*b* does not move to the paper P but remains there. As a result, it is possible to restrain contamination of the paper P. Further, the recesses 77*a* and 77*b* extend to be connected to the first lateral surfaces 75. Hence, when the recesses 77*a* and 77*b* have retained some ink, as compared with the case where the recesses 77*a* and 77*b* extend along the axis L direction, the ink is more likely to move to the first lateral surfaces 75 on the upstream side in the rotational direction due to the rotation of the driven spur 71. As a result, the ink on the apical surfaces 77 of the teeth 72*a* decreases and thus is less transferable to the paper P.

In the rotational direction of the driven spur 71 along with the transport of the paper P, the recesses 75*a* and 75*b* are formed in at least the first lateral surface 75 on the upstream side between the two first lateral surfaces 75 of each tooth 72*a*. As compared with flat surfaces, these recesses 75*a* and 75*b* are also more likely to retain the ink because of the occurrence of capillary action. By virtue of this, the ink retained in the apical surface 77 is more likely to flow from the apical surface 77 to the recesses 75*a* and 75*b*. Further, when the driven spur 71 is rotated along with the transport of the paper P, being subject to air resistance, the ink retained in the apical surface 77 is more likely to move to the first lateral surface 75 on the upstream side than to the first lateral surface 75 on the downstream side among the two first lateral surfaces 75 of each tooth 72*a*. As a result, the ink on the apical surface 77 of the tooth 72*a* decreases and thus is less transferable to the paper P. The recesses 75*a* and 75*b* are linked with the recesses 77*a* and 77*b*. By virtue of this, the ink retained in the recesses 77*a* and 77*b* is more likely to move from the recesses 77*a* and 77*b* to the recesses 75*a* and 75*b*. Hence, the ink on the apical surface 77 of the tooth 72*a* decreases and thus is less transferable to the paper P.

Further, after having contacted with the guide surface 54*a*, the paper P is still transported in the direction J to be drawn to the guide surface 54*a*. On this occasion, a reaction force in a direction T (away from the guide surface 54*a*) acts on the part of the paper P in contact with the teeth 72*a* of the spurs 72 due to the paper P in contact with the guide surface 54*a*. Compared with teeth whose tips are sharply pointed, the teeth 72*a* of the spurs 72 in this embodiment are less likely to pierce the paper P. Therefore, if some force in the direction T acts on the paper P, the paper P is still more likely to move in the direction T. Thus, it is possible to restrain the occurrence of a jam of the paper P. In addition, while each tooth 72*a* of the spurs 72 in this embodiment is less likely to pierce the paper P, it is biased toward the driving roller 61. Therefore, as shown in FIG. 5C, its tooth tip can still cut into the paper P to some extent. That is, the paper P is nipped between the driven spur 71 and driving roller 61 by a nipping force to such an extent that the tip of each tooth 72*a* may cut into the paper P to secure the transport force for the paper P. If in this state the reaction force in the direction T acts on the paper P, then during the tooth 72*a* of the spur 72 being in contact with the paper P, the part of the paper P in contact with the curved surface 77*a*1 (recess 77*a*) receives a force front the tooth 72*a* in a direction indicated by arrow U1 (the normal direction to the curved surface 77*a*1 on the paper P side). This force in the direction U1 acts as a force to crush in the paper P. On the other hand, during the tooth 72*a* being in contact with the paper P, the part of the curved surface 77*a*1 in contact with the paper P also receives a force from the paper P in a direction indicated by arrow U2 (the normal direction to the curved surface 77*a*1 on the tooth 72*a* side). This force in the direction U2 acts as a force to move the driven spur 71 upward. Further, because the recess 77*a* is curved as away from the axis L as away from the guide surface 54*a*, those forces in the directions U1 and U2 act on the contact part between that curved surface 77*a*1 and the paper P. By virtue of this, if the reaction force in the direction T acts on the paper P, then because the force in the direction U2 has acted on the tooth 72*a*, the nipping force of the driving roller 61 and driven spur 71 decreases, thereby causing the apical surface 77 to crush in the paper P which is meanwhile moving in the direction T. Therefore, it is possible to release the reaction force in the direction T acting on the paper P. If supposedly the reaction force in the direction T cannot be released, then this reaction force may become a large rotational load on the driven spur which is then not rotatable, thereby failing to send the paper P. Further, if the reaction force in the direction T cannot be released, then the paper P is held immovably in the direction T relative to the teeth of the driven spur; thereby, the paper P may be sent continuously to the guide surface 54*a*, and thus get bended and flexed between the driven spur and the guide surface 54*a*. Due to at least any one of the above cases, the paper P is subjected to a jam. In this embodiment, however, because it is possible to release the force in the direction T, a jam of the paper P can be restrained.

In this manner, when transporting the paper P, even if the paper P contacts with the guide surface 54*a*, the driving roller 61 and the driven spur 71 still transport and draw the paper P to the guide surface 54*a* side. However, because the spurs 72 are configured such that the paper P is made likely to move in the direction T, it is possible to transport the paper P in the transport direction E while releasing the reaction force on the paper P in the direction T. In this manner, the paper P is positioned in the main scanning direction.

As described hereinabove, according to the printer 1 in this embodiment, because every apical surface 77 of the respective teeth 72*a* of each spur 72 is discontinuous in the circumferential direction R, as compared with a roller having a cylindrical outer periphery, there is a small area of contact with the paper P. Therefore, the ink is less transferable (from the spurs 72) to the paper P. Further, between the two first lateral surfaces 75, at least the first lateral surface 75 on the upstream side has the recesses 75*a* and 75*b*. Thus, the ink adhering to the apical surface 77 of each tooth 72*a* is more likely to flow to the recesses 75*a* and 75*b* of the first lateral surface 75 on the upstream side in the rotational direction due to the rotation of the driven spur 71. As a result, the ink, from the apical surfaces 77 of the teeth 72*a* becomes little and thus less transferable to the paper P. In addition, the teeth 72*a* have the apical surfaces 77 whereby the teeth 72*a* are less likely to pierce the paper P. Hence, even when the driving roller 61 and driven spur 71 draw the paper P to the guide surface 54*a* and cause the paper P to contact with the guide surface 54*a*, and a thrust load (reaction force) occurs on the tooth tips of the spurs 72, the paper P is still likely to move relative to the tooth tips in a direction away from the guide surface 54*a*. As a result, it is possible to restrain the occurrence of a jam of the paper P. Therefore, it is possible to restrain both the occurrence of a jam of the paper P and the occurrence of contamination of the paper P.

Further, each of the apical surfaces 77 has the recess 77*a* formed by the curved surface 77*a*1 curved as away from the axis L as away from the guide surface 54*a*. Therefore, if the reaction force in the direction T acts on the paper P, then the two forces in the direction U1 and the direction U2 act on the part of contact between the paper P and the curved surface 77*a*1. By virtue of this, the paper P is more likely to move in the direction T, and thereby it is possible to release the reaction force acting on the paper P in the direction T. Thus, it is possible to restrain the occurrence of a jam of the paper P.

Figure 6A:
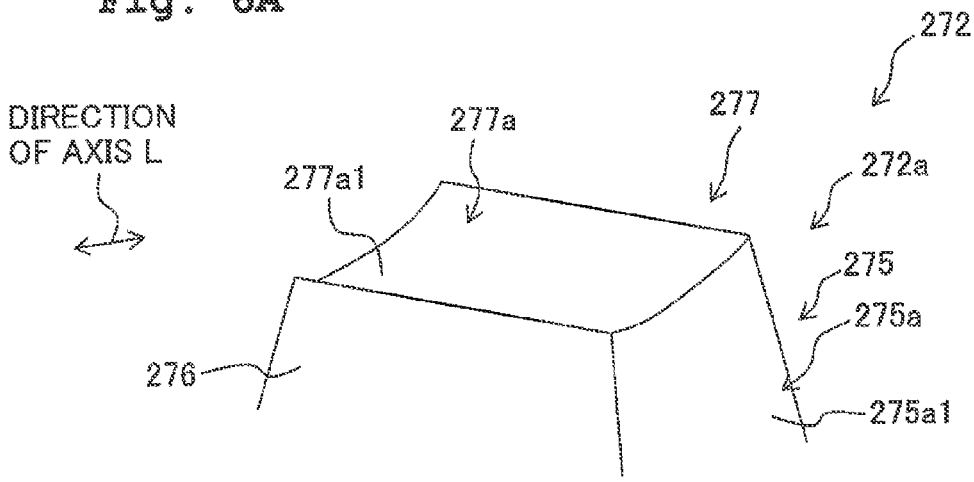
Figure 6B:
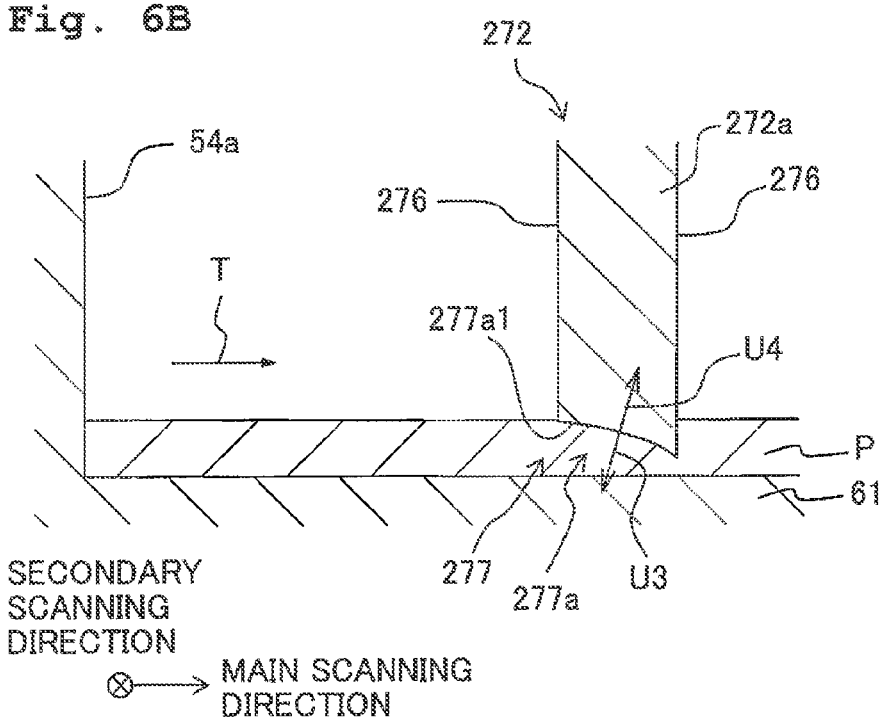
Figure 6C:
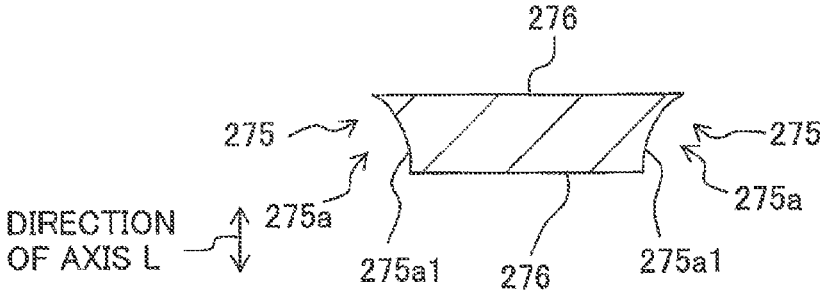

As a modification, as shown in FIGS. 6A to 6C, an apical surface 277 of a tooth 272*a* of a spur 272 may have one recess (second recess) 277*a* extending to he linked to two first lateral surfaces 275. The recess 277*a* is formed of a curved surface 277*a*1 denting toward the axis L side. As shown in FIG. 6B, the curved surface 277*a*1 is curved to get closer to the axis L as from, between two second lateral surfaces 276, the one farther from the guide surface 54*a* (the second lateral surface 276 on the right in the figure) toward the other (the second lateral surface 276 on the left in the figure). Further, as shown in FIG. 6C, each of the two first lateral surfaces 275 of the tooth 272*a* also has one recess (first recess) 275*a*. Each of the recesses 275*a* extends from the tip to the base of the tooth 272*a*, and its one end is linked with the recess 277*a* of the apical surface 277 while its other end is linked with the recess 275*a* of another tooth 272*a* adjacent. Further, the recess 275*a* is formed of a curved surface 275*a*1 denting toward the axis L side. Similar to the curved surface 277*a*1, the curved surface 275*a*1 is also curved.

Further, the spur 272 is produced through one-side etching processing. That is, a mask of a pattern of the spur 272 is applied to (to form a resist on) one side (the second lateral surface 276 on the side near the guide surface 54*a*) of a metallic thin-plate member. Thereafter, a predetermined etching liquid is caused to adhere to the one side of the thin-plate member. By virtue of this, the part not covered by the mask on the thin-plate member is removed front the one side in the axis direction, and the spur 272 is produced. With the spur 272 produced through such one-side etching processing, the apical surface 277 is formed with the one recess 277*a*, and each of the first lateral surfaces 75 is formed with the one recess 275*a*. Through such one-side etching processing, it is possible to form the recesses 275*a* and 277*a* in the spur 272 in a simplified manner.

With the driven spur having such spurs 272, in the same manner as in the aforementioned embodiment, it is possible to position the paper P in its width direction. On this occasion, because it is the apical surfaces 277 of the respective teeth 272*a* that contact with the paper P, the driven spur also has a very small area of contact with the paper P as compared with a roller having a cylindrical outer periphery. Therefore, the same effect is attainable as in the aforementioned embodiment. Further, the apical surfaces 277 are formed with the recesses 277*a*. Compared with flat surfaces, these recesses 277*a* are more likely to retain the ink because of the occurrence of capillary action. Therefore, even if the apical surfaces 277, with the ink retained, contact with the paper P, part of the ink retained in the recesses 277*a* does not move to the paper P but remains there. As a result, it is possible to restrain contamination of the paper P. Further, the recesses 277*a* extend to be linked to the first lateral surfaces 275. Hence, as compared with the case where the recesses 277*a* extend along the axis L direction, the ink retained in the recesses 277*a* is more likely to move to the first lateral surfaces 275 on the upstream side in the rotational direction due to the rotation of the driven spur. As a result, the ink from the apical surfaces 277 of the teeth 272*a* becomes little and thus less transferable to the paper P.

In the rotational direction of the driven spur along with the transport of the paper P, the recess 275*a* is formed in at least the first lateral surface 275 on the upstream side between the two first lateral surfaces 275 of each tooth 272*a*. Compared with flat surfaces, this recess 275*a* is also more likely to retain the ink because of the occurrence of capillary action. By virtue of this, the ink retained in the apical surface 277 is more likely to flow from the apical surface 277 to the recess 275*a*. As a result, the ink from the apical surface 277 of the tooth 272*a* becomes little and thus less transferable to the paper P. The recess 275*a* is linked with the recess 277*a*. By virtue of this, the ink retained in the recess 277*a* is more likely to move from the recess 277*a* to the recess 275*a*. Hence, the ink from the apical surface 277 of the tooth 272*a* becomes little and thus less transferable to the paper P.

In the positioning operation of this modification, after having contacted with the guide surface 54*a*, the paper P is also still transported in the direction J to be drawn to the guide surface 54*a*. That is, in the same manner as in the aforementioned embodiment, a reaction force in the direction T acts on the part of the paper P in contact with the teeth 272*a*. Although each tooth 272*a* in this modification is also less likely to pierce the paper P, because it is biased toward the driving roller 61, as shown in FIG. 6B, its tooth tip still cuts into the paper P to some extent. That is, the paper P is nipped between the driven spur and driving roller 61 by a nipping force to such an extent that the tip of each tooth 272*a* may cut into the paper P to secure the transport force for the paper P. If in this state the reaction force in the direction T acts on the paper P, then during the tooth 272*a* of the spur 272 being in contact with the paper P, the part of the paper P in contact with the curved surface 277*a*1 (recess 277*a*) receives a force from the tooth 272*a* in a direction indicated by arrow U3 (the normal direction to the curved surface 277*a*1 on the paper P side). This force in the direction U3 acts as a force to crush in the paper P. On the other hand, while in contact with the paper P, the part of the curved surface 277*a*1 of the tooth 272*a* in contact with the paper P also receives a force from the paper P in a direction indicated by arrow U4 (the normal direction to the curved surface 277*a*1 on the tooth 272*a* side). This force in the direction U4 acts as a force to move the tooth 272*a* upward. Further, in the same manner as in the aforementioned embodiment, because the recess 277*a* is curved as away from the axis L as away from the guide surface 54*a*, those forces in the directions U3 and U4 act on the contact part between the curved surface 277*a*1 and the paper P. By virtue of this, in the same manner as in the aforementioned embodiment, if a reaction force in the direction T acts on the paper P, then the apical surface 277 crushes in the paper P which is meanwhile moving in the direction T. Therefore, it is possible to release the reaction force in the direction T acting on the paper P. As a result, a jam of the paper P can he restrained.

As described hereinabove, in this modification, because every apical surface 277 of the respective teeth 272*a* of the spur 272 is discontinuous in the circumferential direction R, as compared with a roller having a cylindrical outer periphery, there is a smaller area of contact with the paper P. Therefore, the ink is less transferable (from the spurs 272) to the paper P. Further, between the two first lateral surfaces 275, at least the first lateral surface 275 on the upstream side has the recess 275*a*. Thus, the ink adhering to the apical surface 277 of each tooth 272*a* is more likely to flow to the recess 275*a* of the first lateral surface 275 on the upstream side in the rotational direction due to the rotation of the driven spur. As a result, the ink from the apical surfaces 277 of the teeth 272*a* becomes little and thus less transferable to the paper P. In addition, the teeth 272*a* have the apical surfaces 277 whereby the teeth 272*a* are less likely to pierce the paper P. Hence, even when the driving roller 61 and driven spur draw the paper P to the guide surface 54*a* and cause the paper P to contact with the guide surface 54*a*, and a thrust load (reaction force) occurs on the tooth tips of the spur 272, the paper P is still more likely to move relative to the tooth tips in a direction away from the guide surface 54*a*. As a result, it is possible to restrain the occurrence of a jam of the paper P. Therefore, it is possible to restrain both the occurrence of a jam of the paper P and the occurrence of contamination of the paper P.

Hereinabove, a preferred embodiment of the present invention was explained. However, the present invention is not limited to the above embodiment, but is changeable in various manners as far as within the scope described in the appended claims. For example, in the above embodiment and modification, while the apical surfaces 77 and 277 respectively have the recesses 77*a* and 77*b*, and 277*a*, it is also possible for the apical surfaces not to have these recesses 77*a* and 77*b*, and 277*a*. That is, the apical surfaces may also be flat surfaces. On such an occasion, the first lateral surfaces 75 and 275 may respectively have the recesses 75*a* and 75*b*, and 275*a*. In such a configuration, even though the apical surfaces are fiat, the ink adhering to the apical surfaces are still more likely to move from the apical surfaces to the first lateral surfaces 75 and 275. Therefore, in the same manner as described earlier, the ink from the apical surfaces becomes little and thus less transferable to the paper P. Further, it is also possible for the apical surfaces to have a projective shape projecting in a direction away from the axis L.

Further, it is also possible for the recesses 77*a* and 77*b* in the above embodiment and the recesses 277*a* in the above modification to extend in the axis L direction. Further, the recesses 77*a* and 77*b*, and 277*a* may also be formed through mechanical processing other than etching processing. Further, it is also possible for the apical surfaces to have three or more recesses. Further, the recesses 77*a* and 77*b*, and 277*a* may not be linked to the two first lateral surfaces 75, and the two lateral surfaces 275, respectively. On such an occasion, flat surfaces may exist entirely or partially around the recesses 77*a* and 77*b*, and 277*a*, respectively. Further, while the recesses 77*a* and 77*b*, and 277*a* are formed respectively of the curved surfaces 77*a*1 and 77*b*1, and 277*a*1, the present invention is not particularly limited to this. That is, as long as the recesses of the apical surfaces 77 and 277 are shaped to dent toward the axis L side, any shapes are possible such as circle, V configuration, multiangular shape, etc. Further, it is also possible for the recesses 75*a* and 75*b*, and 275*a* not to be linked with the recesses 77*a* and 77*b*, and 277*a*, respectively.

While the driven spur has the four spurs 72 or 272, it may have any number of spurs from one to three or five or more. Further, the positioning mechanism 50 may also be provided in the downstream guide portion 3*b*. Thereby, the paper P is positioned and then discharged to the paper discharge portion 4.

The present invention is applicable to both line and serial printers. Further, without being limited to printers, the present invention is also applicable to facsimile machines, copy machines, etc. Further, the present invention is also applicable to any types of recording apparatuses such as, for example, laser type, thermal type, etc., as long as the recording apparatuses function to record images. The recording medium is not limited to the paper P, but may adopt various other media capable of image recording.

What is claimed is:

1. A recording apparatus comprising:

a recording section configured to jet a liquid; and a transport mechanism configured to transport a recording medium on which an image is recorded by the liquid jetted from the recording section, wherein the transport mechanism includes: a guide surface extending linearly and configured to guide one of two lateral ends of the recording medium transported; a driving roller configured to contact with one surface of the recording medium on a side with no image recorded and to transport the recording medium; and a driven spur having at least one spur configured to contact with the other surface of the recording medium on the side with the image recorded so as to nip the recording medium in cooperation with the driving roller, and to rotate along with the transport of the recording medium by the rotation of the driving roller, an angle formed by a portion of the guide surface, which is disposed on a downstream side in a transport direction for transporting the recording medium from a point of intersection between an axis of a rotational shaft of the driven spur and the guide surface, and the axis of the rotational shaft of the driven spur is an acute angle, the spur has a plurality of teeth arranged to align in a circumferential direction about the axis of the rotational shaft of the driven spur and each projecting in a direction orthogonal to the axis of the rotational shaft of the driven spur as viewed from an axis direction along the axis of the rotational shaft of the driven spur, each of the teeth has two first lateral surfaces inclined to get closer to a virtual line orthogonal to the axis from a base to a tip of the tooth as viewed from the axis direction, and an apical surface formed at a position closer to the axis than a line of intersection between two virtual planes extending along the two first lateral surfaces, and at least one first lateral surface among the two first lateral surfaces has a first recess denting toward the rotational shaft and connected to the apical surface, the at least one first lateral surface being disposed on an upstream side with respect to a rotational direction in which the driven spur is rotated along with the transport of the recording medium.

2. The recording apparatus according to claim 1, wherein the apical surface has at least one second recess denting toward the rotational shaft.

3. The recording apparatus according to claim 2, wherein the second recess extends to be connected to the two first lateral surfaces.

4. The recording apparatus according to claim 3, wherein the first recess is connected to the second recess.

5. The recording apparatus according to claim 2, wherein the apical surface has two second recesses arranged in the axis direction.

6. The recording apparatus according to claim 5, wherein each of the plurality of teeth has two second lateral surfaces orthogonal to the axis, one of the two second recesses is curved to get closer to the axis from a center of the apical surface in the axis direction toward one of the two second lateral surfaces, and the other of the two second recesses is curved to get closer to the axis from the center of the apical surface toward the other of the two second lateral surfaces.

7. The recording apparatus according to claim 6, wherein the two second recesses are formed through two-side etching processing in the axis direction.

8. The recording apparatus according to claim 2, wherein each of the plurality of teeth has two second lateral surfaces orthogonal to the axis, the apical surface has one second recess, and the one second recess is curved to get closer to the axis from one of the two second lateral surfaces toward the other of the two second lateral surfaces.

9. The recording apparatus according to claim 8, wherein the second recess is formed through one-side etching processing in the axis direction.

10. The recording apparatus according to claim 8, wherein one of the two second lateral surfaces is far from the guide surface as compared with the other of the two second lateral surfaces.

11. The recording apparatus according to claim 1, wherein one of the two first lateral surfaces, which is disposed on a downstream side with respect to the rotational direction in which the driven spur is rotated along with the transport of the recording medium, has the first recess denting toward the rotational shaft and connected to the apical surface.

* * * * *